US005525088A

United States Patent [19]

Mayne

[11] Patent Number: 5,525,088

[45] Date of Patent: Jun. 11, 1996

[54] SOFT SCULPTURE TOY APPARATUS

[76] Inventor: Louise L. Mayne, 7 Twin Maple Dr., Bethel, Conn. 06801

[21] Appl. No.: 339,494

[22] Filed: Nov. 14, 1994

[51] Int. Cl.[6] ..... A63H 3/52; B65D 73/00

[52] U.S. Cl. ..... 446/75; 446/76; 446/476; 206/457

[58] Field of Search ..... 446/75, 76, 71, 446/476, 478; 206/309, 457; 150/154; 190/109

[56] References Cited

U.S. PATENT DOCUMENTS

| | | | |
|---|---|---|---|
| D. 325,059 | 3/1992 | Smallwood | D21/159 |
| 2,484,895 | 10/1949 | Links . | |
| 2,484,896 | 10/1949 | Links | D21/159 |
| 3,503,141 | 3/1970 | Schwartz | D21/159 |
| 3,553,851 | 1/1971 | Paige | D21/159 |
| 3,964,188 | 6/1976 | Dimitracopoulos | D21/159 |
| 4,152,865 | 5/1979 | Ikeda | D21/159 |
| 4,365,438 | 12/1982 | Nelson | D21/159 |
| 4,853,994 | 8/1989 | Ekstein | 446/73 X |
| 4,862,438 | 8/1989 | Fry . | |
| 4,874,340 | 10/1990 | Smallwood | 446/72 X |
| 5,002,401 | 3/1991 | Blackman | 190/109 X |
| 5,059,149 | 10/1991 | Stone | 446/73 |
| 5,074,417 | 12/1991 | Kenny | 446/73 X |
| 5,326,300 | 7/1994 | Sonders | 446/74 |

FOREIGN PATENT DOCUMENTS

| | | | |
|---|---|---|---|
| 0578486 | 1/1994 | European Pat. Off. | 446/397 |
| 341146 | 1/1931 | United Kingdom | 446/397 |

*Primary Examiner*—Mickey Yu
*Attorney, Agent, or Firm*—Ware, Fressola, Van Der Sluys & Adolphson

[57] ABSTRACT

A soft sculpture toy apparatus having one or more storage slots for a compact disc and/or cassette tape and a book. The apparatus also includes one or more storage cavities located within the apparatus having a storage flap for storing a plurality of toys used with the apparatus. Finally, the apparatus may include a satchel for storing and transporting the apparatus and the plurality of toys.

19 Claims, 4 Drawing Sheets

210
212
214
216
218
220
222
224
226
228
230
232
234
234
5
5
6
6
310
312
314
316
318
320
322
324

SOFT SCULPTURE TOY APPARATUS

BACKGROUND OF THE INVENTION

1. Field of the Invention

The present invention generally relates to a soft sculpture toy apparatus, and in particular, relates to one such soft sculpture toy apparatus having one or more storage slots for storing compact discs, books and cassette tapes, one or more toy storage cavities and a satchel for storing and transporting the apparatus and a plurality of toys.

2. Description of the Prior Art

For a long time, toys have been used with books as teaching aids. Forming a natural combination, toys can be used to reinforce and almost bring to life a particular theme taught in a book. Because of children's seemingly natural fondness for stuffed animals, they are particularly well suited for use with books. Even a simple stuffed animal version of a character in a book can have great teaching benefits. For example, U.S. Pat. No. 4,608,024 issued to Skolnick on Aug. 26, 1986, discloses a book with an attached puppet, which can be concealed inside and used with the book. The puppet can be used by a teacher to tell the story taught by the book. Similarly, U.S. Pat. No. 4,365,438 issued to Nelson on Dec. 28, 1982, discloses a combination toy and book wherein the toy can be used with each page of the book, each page having graphical material which cooperates with the toy. In addition, U.S. Pat. No. 4,874,340 issued to Smallwood on Oct. 17, 1990, discloses a stuffed animal book where a book is held inside stuffed animal halves. Toys have also been used with greeting cards to emphasize a particular theme. For example, U.S. Pat. No. 4,152,865 issued to Ikeda on May 8, 1979, discloses a greeting card with a holding toy. The card has a cutout section for attaching a stuffed animal having spring loaded limbs.

"Soft sculpture" toys have also been used with books as teaching aids. Soft sculpture toys have a pliable or flexible outer shell with enough structural rigidity to be free standing. The outer shell is typically made of fabric, rubber or plastic, although a variety of other materials have also been used. Those having an outer shell of fabric usually have some kind of stuffing such as foam or batting to provide shape and structural strength. Soft sculpture toys can be a small, individual character or a much larger character or structure such as a dinosaur or house.

Historically, the toy industry has been fertile ground for the application of new technology. For example, U.S. Pat. No. 2,484,895 issued to Links on Oct. 18, 1949, discloses an educational toy book which includes a story, doll and music. The story is read to music as a child plays with the doll. More recently, the introduction of compact discs, CD ROMs and multi-media technology has revolutionized the toy industry and opened up new opportunities in the education and entertainment fields. Now, many book and toy combinations are accompanied by a compact disc or CD ROM which can provide spoken words, music as well as sophisticated graphics. However, there is still a need to support the large base of customers who do not have this newer technology. Consequently, it is not uncommon to find a toy being sold with a book, compact disc and/or a cassette tape. Unfortunately, although these items may be sold together, they are usually separate items without a common storage methodology making it difficult to keep them together, especially when more and more toys are sold with CDs, CD ROMs and cassette tapes.

There have been some advances in common storage techniques. For example, U.S. Pat. No. 5,059,149 issued to Stone on Oct. 22, 1991, discloses a stuffed animal apparatus including one or more storage compartments in which books may be stored. Similarly, U.S. Pat. No. 3,505,141 issued to Schwartz on Mar. 31, 1970, discloses an instruction book with recesses for holding a cassette tape. However, none of these inventions provide a means for storing compact discs, books, cassette tapes and toys together in one apparatus. Consequently, there is a need for a soft sculpture toy apparatus having the capability to store compact discs, books, cassette tapes, or the like, and toys. Such a toy apparatus would be particularly useful in an educational environment where several such apparatuses having different themes are used and stored in the same room. Each apparatus could include, as part of its story, instructions on how to remove and use the compact disc or cassette tape and toys, as well as instructions for returning these items to the apparatus when the lesson is finished.

DISCLOSURE OF THE INVENTION

The present invention is designed to overcome the limitations discussed above and towards that end it includes a novel soft sculpture toy apparatus having the capability to store compact discs, books, cassette tapes, or the like, and toys within the apparatus itself.

Accordingly, it is one object of the present invention to provide a free standing, soft sculpture toy apparatus made of a soft, pliable material.

It is also an object of the present invention to provide a soft sculpture toy apparatus having a plurality of storage slots for storing an audio medium such as a compact disc, a cassette tape, or the like, and a book.

A further object of the present invention is to provide a soft sculpture toy apparatus having a toy storage cavity for storing a plurality of toys.

Still another object of the present invention is to provide a soft sculpture toy apparatus having a plurality of toys which can be stored in the toy storage cavity.

Yet another object of the present invention is to provide a soft sculpture toy apparatus which includes a satchel for storing and transporting the soft sculpture toy apparatus and a plurality of toys used with the apparatus.

The foregoing objects are accomplished, at least in part, by a free standing soft sculpture toy apparatus, wherein the apparatus includes a plurality of storage slots, a toy storage cavity, a plurality of toys stored in the toy storage cavity and a satchel for storing and transporting the apparatus and toys.

The present invention offers several advantages over the prior art. First, the apparatus includes storage slots for an audio medium such as a compact disc, a cassette tape, or the like, and a book, as well as one or more toy storage cavities and a plurality of toys which can be stored in the cavities. The combination of storage slots and toy storage cavities allows all the materials and toys which are used together to be stored together in one location, minimizing the chance that they will be lost and making it easier to locate and use them together. Finally, the apparatus includes a satchel for storing and transporting the soft sculpture apparatus and a plurality of toys used with the apparatus. The satchel provides for the storage and transportation of any additional toys that might be used with the apparatus and also serves as a storage area when not in use.

Other objects and advantages will become apparent to those skilled in the art from the following detailed description read in conjunction with the appended claims and drawings attached hereto.

BRIEF DESCRIPTION OF THE DRAWINGS

The drawings, not drawn to scale, include.

BEST MODE FOR CARRYING OUT THE INVENTION

Figure 1:
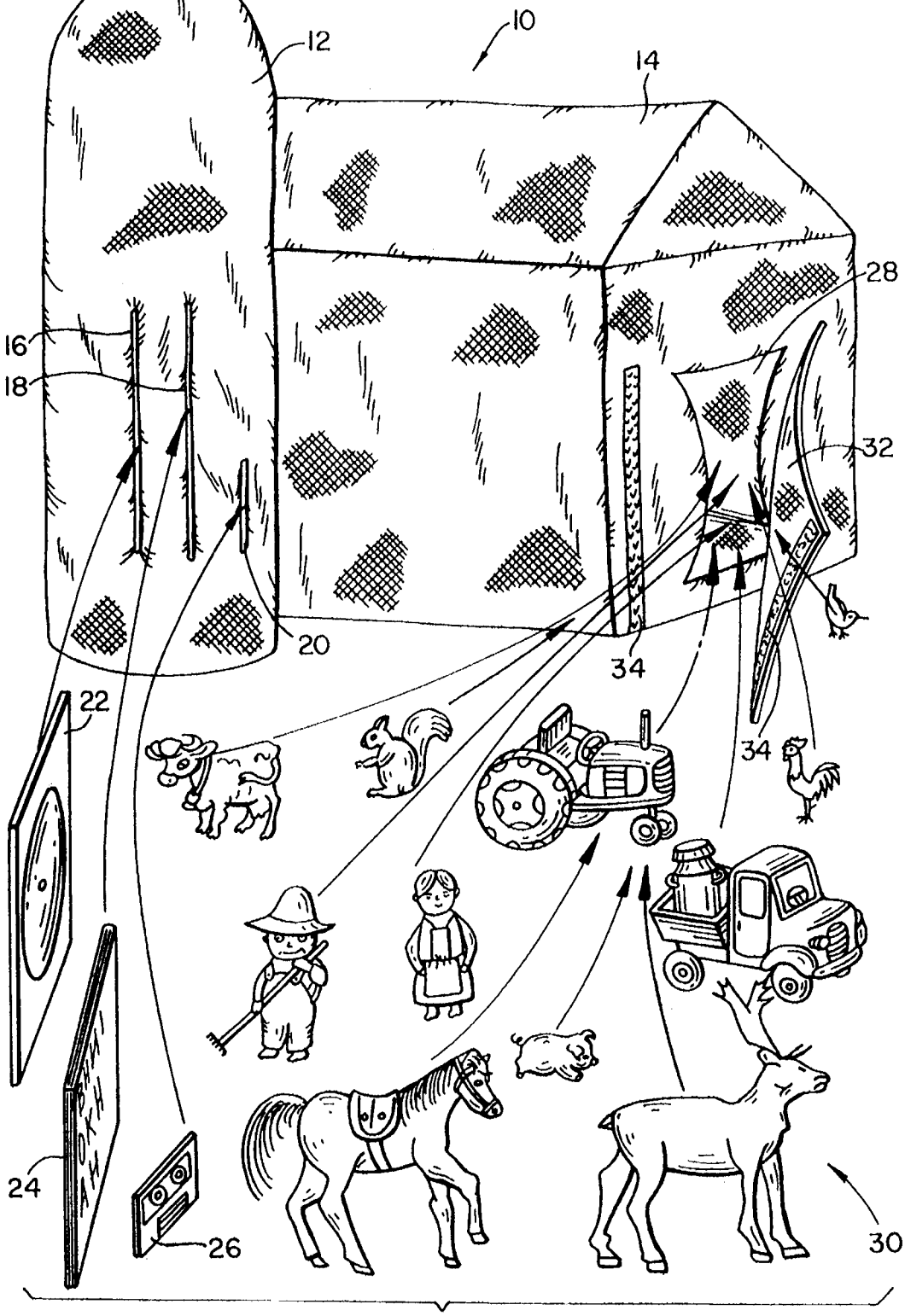
FIG. 1, which is a perspective view of a soft sculpture toy apparatus embodying the principles of the present invention.

A soft sculpture toy apparatus embodying the principles of the present invention is a farmhouse generally indicated at 10 in FIG. 1. As a soft sculpture toy, the apparatus is typically flexible and soft yet rigid enough to be free standing. The outer shell can be made from a variety of materials including cloth, plastic, rubber or other suitable material which is somewhat flexible and soft, yet has or can be made to have sufficient rigidity to allow the apparatus to be free standing. The apparatus may be filled with a filling material or have some other internal structure for support. For example, a soft sculpture toy apparatus having an outer cloth material covering could include a batting material or a foam rubber material or other suitable material to provide sufficient support for the apparatus to be free standing. Alternatively, the apparatus could be hollow and have an outer shell with sufficient rigidity to allow it to be free standing. It will be appreciated by one skilled in the art that many such alternatives are possible.

Figure 2:
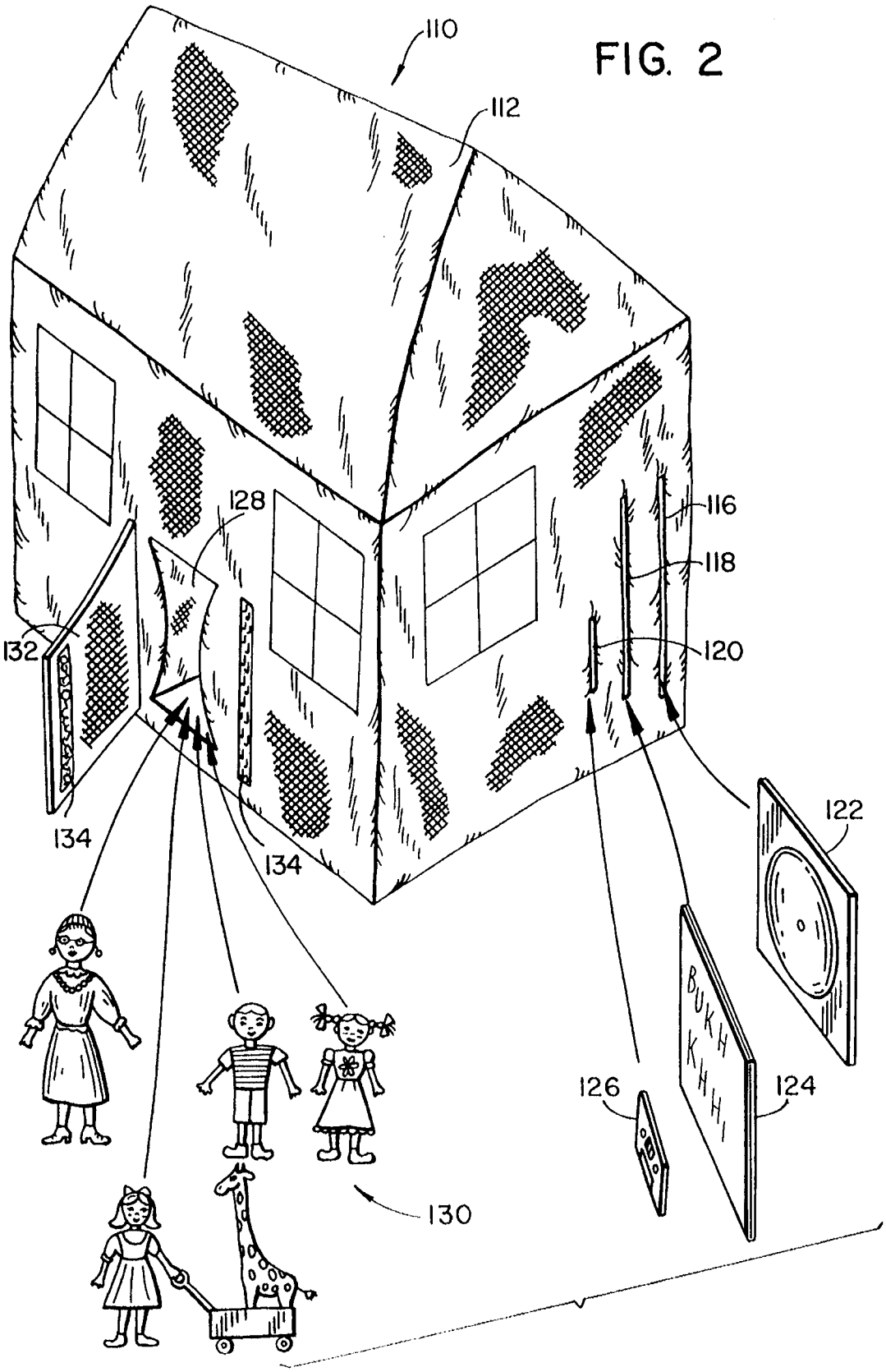
FIG. 2, which is a perspective view of a second embodiment of a soft sculpture toy apparatus also embodying the principles of the present invention.
Figures 3, 4:
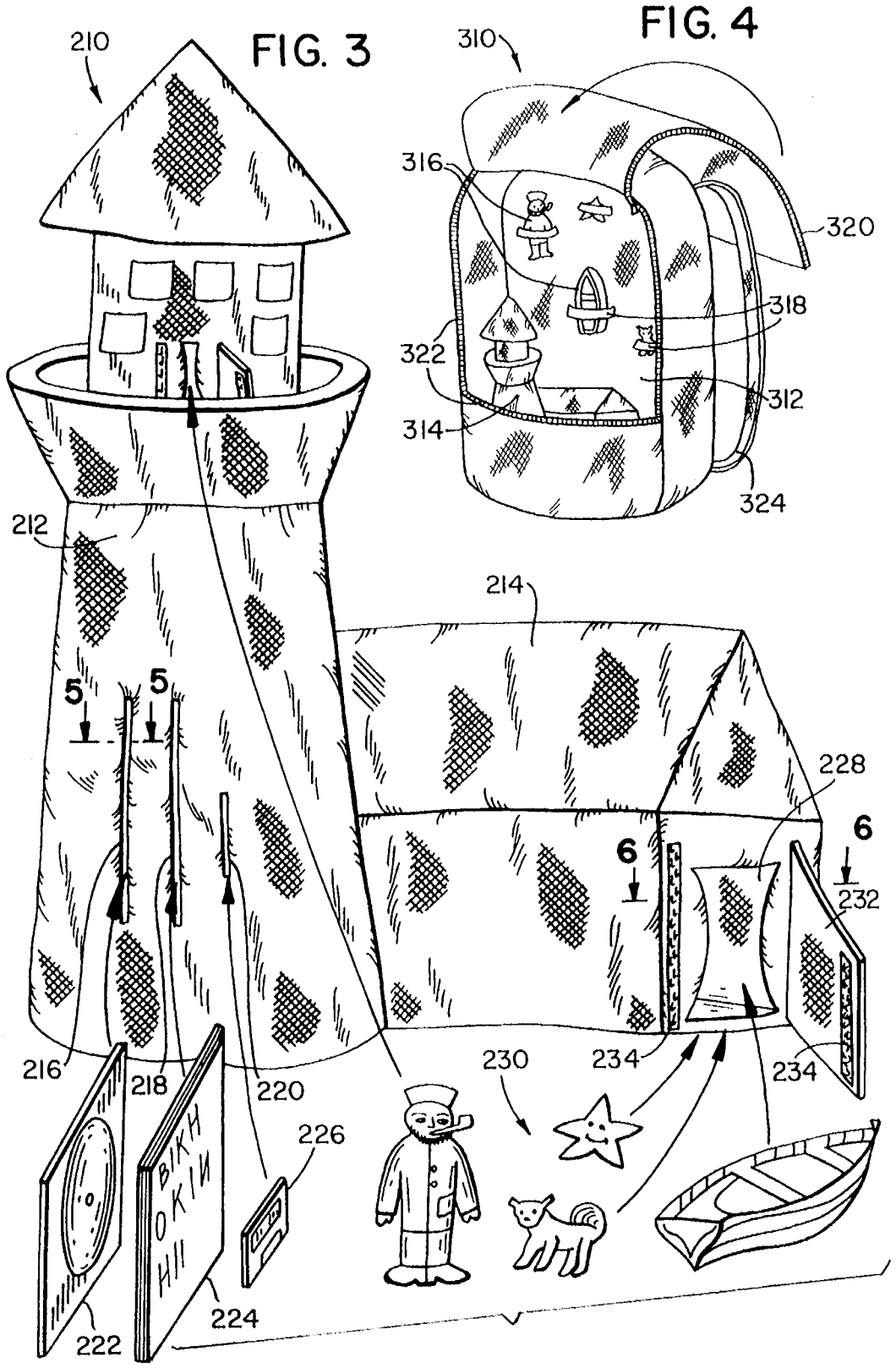
FIG. 3, which is a perspective view of a third embodiment of a soft sculpture toy apparatus also embodying the principles of the present invention.
FIG. 4, which is a perspective view of a satchel used with a soft sculpture toy apparatus and also embodying the principles of the present invention.
Figure 5:
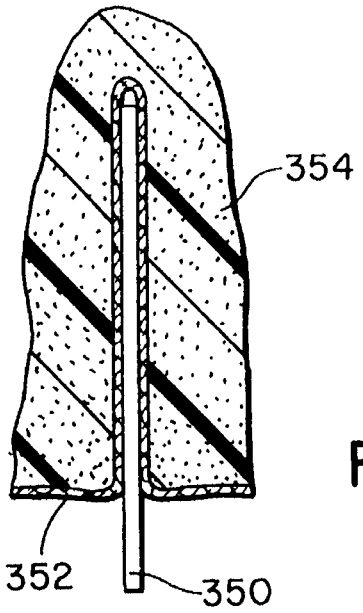
FIG. 5, which is an enlarged, fragmentary top cross sectional elevation view of the one or more compact disc slots shown in FIGS. 1, 2, 3.

The farmhouse includes a silo portion 12 and a barn portion 14. The silo portion 12 features a number of storage slots which may include, e.g., one or more compact disc storage slots 16, one or more book storage slots 18 and one or more cassette tape storage slots 20. Each type of storage slot is formed and dimensioned according to its purpose and use. For example, the one or more compact disc storage slots 16 would be formed and sized to receive and firmly hold one or more compact discs 22. Similarly, the one or more book storage slots 18 would be formed and sized to receive and firmly hold one or more books 24. Finally, the one or more cassette tape storage slots 20 would be formed and sized to receive and firmly hold cassette tapes 26 either in or out of their cassette storage box. Each of the storage slots is constructed so that its respective storage item can be easily inserted and removed. However, each storage slot also has sufficient rigidity and holding characteristics to store its respective object. As shown in FIGS. 1, 2 and 3, the storage slots are arranged vertically. However, it is understood and will be appreciated by one skilled in the art that the slots can be located anywhere in the apparatus and may be arranged vertically, horizontally or at any other suitable angle. FIG. 5 is an enlarged, fragmentary top cross sectional elevation view of the one or more compact disc slots 16 shown in FIG. 1, the one or more compact disc slots 116 shown in FIG. 2 and the one or more compact disc slots 216 shown in FIG. 3. As shown in FIG. 5, the outer shell 352 is formed in the shape of a slot, dimensioned to receive a compact disc 350. As explained before, the outer shell 352 could be made from a variety of materials including, cloth, plastic, rubber or other suitable material. Also shown is a packing material 354, which provides support behind the outer shell 352 and packed around the slot so that the compact disc 350 will be firmly held in place. The packing material 354 could be selected from a variety of materials, as mentioned before, such as batting or foam rubber. In addition, the packing material 354 need not be the same as any other material in the apparatus and need not provide any structured rigidity other than that provided to the outer shell 352 forming the slot. It is even envisioned that the packing material 354 could be held in a cavity surrounding the slot for providing support to the slot only. In this manner, a compact disc 350 can be easily inserted and removed from the slot but is also firmly held in place. The one or more book storage slots 18 and the one or more cassette tape storage slots 20 are formed and dimensioned in the same manner so that one or more books 24 and one or more cassette tapes 26 can be easily inserted and removed from their respective slots while being firmly held in place.

It should be realized that the choice of slots is up to the designer, depending on the combination of book, CD, cassette tape, etc. that is chosen for a particular embodiment.

Figure 6:
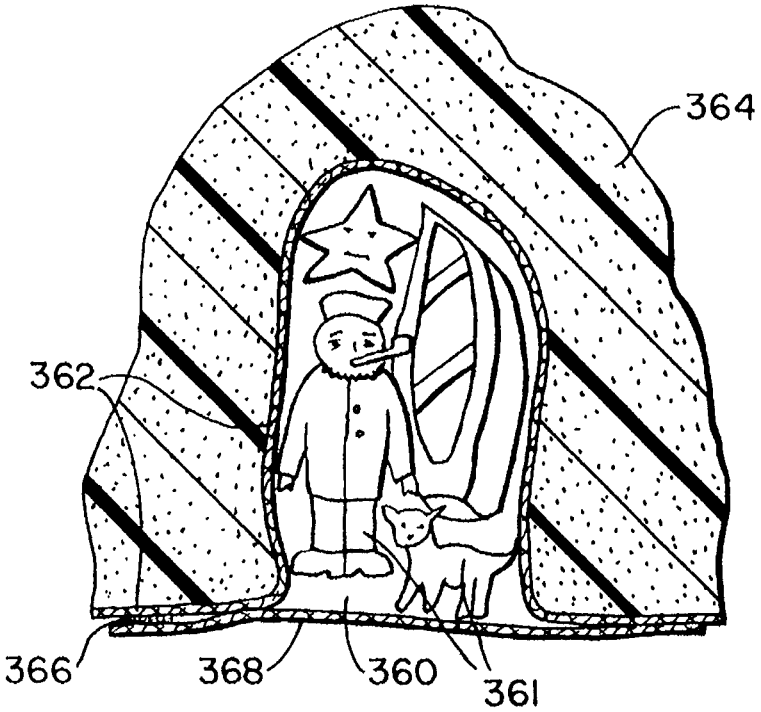
FIG. 6, which is an enlarged, partial, cross-sectional elevation view of the one or more toy storage cavities shown in FIGS. 1, 2, 3.

Continuing with the soft sculpture toy apparatus shown in FIG. 1, the barn portion 14 also includes one or more toy storage cavities 28 for storing a plurality of toys 30. FIG. 6 is an enlarged, partial, cross-sectional elevation view of the one or more toy storage cavities 28 shown in FIG. 1. The outer shell 362 of the apparatus is formed to create a cavity 360 for holding a plurality of toys 361. The cavity 360 is surrounded by a packing material 364 for providing support behind the outer shell 362 so that the plurality of toys 361 can be supported within the cavity 360.

The barn portion 14 also includes one or more cavity flaps 32 for holding the plurality of toys 30 in the one or more toy storage cavities 28. As shown in FIG. 6, the cavity flap 368 is attached to the outer shell 362 and is used for covering the cavity 360 opening so that the plurality of toys 361 are held inside the cavity 360. The cavity flap 368 may be made from a variety of materials such as cloth, plastic or rubber or other suitable material, the same as or different than the outer shell 362 material. The cavity flap 368 can be attached to the outer shell 362 with glue, staples, stitches, rivets, Velcro® fastener, or any other means suitable for the material selected.

The barn portion 14 also includes securing means 34 (366 in FIG. 6) for allowing selective movement of the cavity flap 32 between a closed position and an open position. When the cavity flap 32 is in the closed position, the plurality of toys 30 are securely held in the toy storage cavity 28. When the cavity flap 32 is in the open position, a user has access to the plurality of toys 30 in the toy storage cavity 28. The securing means 34 could include a material such as Velcro® material from Velcro Corporation of New York, a zipper or other suitable material. It will be appreciated by one skilled in the art that many materials and configurations are possible and could be used effectively.

Another soft sculpture toy apparatus embodying the principles of the present invention is generally indicated at 110 in FIG. 2, and includes as the main body a schoolhouse 112. The schoolhouse 112 features a number of storage slots which may include one or more compact disc storage slots 116, one or more book slots 118 and one or more cassette tape slots 120. As in the first embodiment, the one or more compact disc storage slots 116 are formed and dimensioned to receive and firmly hold one or more compact discs 122. Similarly, the one or more book slots 118 are formed and dimensioned to receive and firmly hold one or more books 124. Finally, the one or more cassette tape slots 120 are formed and dimensioned to receive and firmly hold one or more cassette tapes 126.

The schoolhouse 110 also includes one or more toy storage cavities 128 for storing a plurality of toys 130, a cavity flap 132 attached to the schoolhouse and securing means 134. As with the first embodiment the securing means 134 allows selected movement of the cavity flap 132 between a closed position and an open position. When the cavity flap 132 is in the closed position, the plurality of toys 130 are held inside the toy storage cavity 128 when the cavity flap 132 is in the open position, a user has access to the plurality of toys 130 held inside the toy storage cavity 128.

Another soft sculpture toy apparatus embodying the principles of the present invention is a lighthouse generally indicated at 210 in FIG. 3 and includes a tower portion 212 and a house portion 214. As with the other embodiments, the tower portion 212 features a number of storage slots including one or more compact disc storage slots 216, one or more book storage slots 218 and one or more cassette tape storage slots 220 which, as with the previous embodiments are formed and dimensioned to receive and firmly hold one or more compact discs 222, one or more books 224 or one or more cassette tapes 226 respectively.

As with the previous embodiments, the house portion 214 also includes one or more toy storage cavities 228 formed and sized to receive a plurality of toys 230. The house portion 214 also includes a cavity flap 232 and securing means 234 for allowing selective movement of the cavity flap 232 between a closed position and an open position.

Another aspect of the present invention is to include a satchel that is generally indicated at 310 in FIG. 4. It will be understood by one skilled in the art that the satchel could be made of many suitable materials including but not limited to leather, nylon and plastic.

The satchel includes a storage cavity 312 for holding one or more soft sculpture toy apparatus 314 and a plurality of toys 316. The satchel also includes retaining means 318 attached to the inside of the satchel for securing the plurality of toys 316 within the storage cavity 312. It is understood that the retaining means 318 could include elastic bands, Velcro® fabric, or other suitable means. Although FIG. 4 shows the retaining means 318 as being attached to the back wall of the satchel, it is understood that the retaining means 318 could be located anywhere within the satchel including along the inside side walls.

The satchel also includes a satchel flap 320 which is attached to the satchel and which can be closed to hold the plurality of toys 316 and the one or more soft sculpture toy apparatus 316 within the storage cavity 312. The satchel also includes securing means 322 such as a zipper for securing the satchel flap 320 to the satchel in a closed position for retaining the plurality of toys 316 and the one or more soft sculpture toy apparatus 314 within the storage cavity 312. Although a zipper is shown in FIG. 4, it is understood that many other securing means 322 could be used. The satchel also includes carrying means 324 for transporting the satchel 310 and its contents. The carrying means 324 may comprise a strap or other suitable alternatives. It will be appreciated by one skilled in the art that many such carrying means are possible. Such may include carrying means formed in the shape of the toy. In such a case, for example, the satchel of FIG. 4 would have the shape of a lighthouse, schoolhouse, farmhouse, or the like.

Although the present invention has been described and discussed herein with respect to one or more embodiments, other arrangements or configurations may also be used that do not depart from the spirit and scope hereof. Hence, the present invention is deemed limited only by the appended claims and the reasonable interpretation thereof.

What is claimed is:

1. A soft sculpture toy apparatus comprising:

a main body having one or more resiliently deformable audio media storage slots disposed in said main body for storing one or more audio media, one or more resiliently deformable book storage slots disposed in said main body for storing one or more books, and one or more toy storage cavities disposed in said main body for storing a plurality of toys;

one or more storage flaps attached to said main body for covering said one or more toy storage cavities, said one or more storage flaps being movable between an open position and a closed position, said open position providing access to said one or more toy storage cavities, said closed position retaining the plurality of toys in said one or more toy storage cavities; and securing means for maintaining said one or more storage flaps in said closed position, wherein said main body is a simulated barn portion with an attached simulated silo portion.

2. The soft sculpture toy apparatus as claimed in claim 1 wherein said one or more resiliently deformable audio media storage slots are disposed in said simulated silo portion, said one or more resiliently deformable book storage slots are disposed in said simulated silo portion, and said one or more toy storage cavities are disposed in said simulated barn portion.

3. The soft sculpture toy apparatus as claimed in claim 1 wherein said soft sculpture toy apparatus further includes one or more audio media comprising one or more compact discs for being stored in said audio media storage slots.

4. The soft sculpture toy apparatus as claimed in claim 1 wherein said soft sculpture toy apparatus further includes one or more books for being stored in said book storage slots.

5. The soft sculpture toy apparatus as claimed in claim 1 wherein said soft sculpture toy apparatus further includes one or more audio media comprising one or more cassette tapes for being stored in said audio media storage slots.

6. The soft sculpture toy apparatus as claimed in claim 1 wherein said soft sculpture toy apparatus further includes a plurality of toys for being stored in said one or more toy storage cavities.

7. The soft sculpture toy apparatus as claimed in claim 1 wherein said soft sculpture toy apparatus further includes one or more audio media for being stored in said audio media storage slots and one or more books for being stored in said book storage slots.

8. A soft sculpture toy apparatus comprising:

a main body having one or more resiliently deformable audio media storage slots disposed in said main body for storing one or more audio media, one or more resiliently deformable book storage slots disposed in said main body for storing one or more books, and one or more toy storage cavities disposed in said main body for storing a plurality of toys;

one or more storage flaps attached to said main body for covering said one or more toy storage cavities, said one or more storage flaps being movable between an open position and a closed position, said open position providing access to said one or more toy storage cavities, said closed position retaining the plurality of toys in said one or more toy storage cavities; and securing means for maintaining said one or more storage flaps in said closed position, wherein said main body is a simulated house.

9. The soft sculpture toy apparatus as claimed in claim 8 wherein said soft sculpture toy apparatus further includes one or more audio media comprising one or more compact discs for being stored in said audio media storage slots.

10. The soft sculpture toy apparatus as claimed in claim 8 wherein said soft sculpture toy apparatus further includes one or more books for being stored in said book storage slots.

11. The soft sculpture toy apparatus as claimed in claim 8 wherein said soft sculpture toy apparatus further includes one or more audio media comprising one or more cassette tapes for being stored in said audio media storage slots.

12. The soft sculpture toy apparatus as claimed in claim 8 wherein said soft sculpture toy apparatus further includes a plurality of toys for being stored in said one or more toy storage cavities.

13. The soft sculpture toy apparatus as claimed in claim 8 wherein said soft sculpture toy apparatus further includes one or more audio media for being stored in said audio media storage slots and one or more books for being stored in said book storage slots.

14. A soft sculpture toy apparatus comprising:

a main body having one or more resiliently deformable audio media storage slots disposed in said main body for storing one or more audio media, one or more resiliently deformable book storage slots disposed in said main body for storing one or more books, and one or more toy storage cavities disposed in said main body for storing a plurality of toys;

one or more storage flaps attached to said main body for covering said one or more toy storage cavities, said one or more storage flaps being movable between an open position and a closed position, said open position providing access to said one or more toy storage cavities, said closed position retaining the plurality of toys in said one or more toy storage cavities; and securing means for maintaining said one or more storage flaps in said closed position, wherein said main body is a simulated lighthouse.

15. The soft sculpture toy apparatus as claimed in claim 14 wherein said soft sculpture toy apparatus further includes one or more audio media comprising one or more compact discs for being stored in said audio media storage slots.

16. The soft sculpture toy apparatus as claimed in claim 14 wherein said soft sculpture toy apparatus further includes one or more books for being stored in said book storage slots.

17. The soft sculpture toy apparatus as claimed in claim 14 wherein said soft sculpture toy apparatus further includes one or more audio media comprising one or more cassette tapes for being stored in said audio media storage slots.

18. The soft sculpture toy apparatus as claimed in claim 14 wherein said soft sculpture toy apparatus further includes a plurality of toys for being stored in said one or more toy storage cavities.

19. The soft sculpture toy apparatus as claimed in claim 14 wherein said soft sculpture toy apparatus further includes one or more audio media for being stored in said audio media storage slots and one or more books for being stored in said book storage slots.

* * * * *